US011504968B2

(12) United States Patent
Matsumoto et al.

(10) Patent No.: US 11,504,968 B2
(45) Date of Patent: Nov. 22, 2022

(54) LIQUID EJECTION HEAD AND LIQUID EJECTION APPARATUS

(71) Applicant: CANON KABUSHIKI KAISHA, Tokyo (JP)

(72) Inventors: Keiji Matsumoto, Kanagawa (JP); Shinji Kishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

(21) Appl. No.: 17/142,405

(22) Filed: Jan. 6, 2021

(65) Prior Publication Data

US 2021/0206167 A1 Jul. 8, 2021

(30) Foreign Application Priority Data

Jan. 7, 2020 (JP) ..... JP2020-000878

(51) Int. Cl.
*B41J 2/14* (2006.01)
*B41J 2/165* (2006.01)
*B41J 2/145* (2006.01)

(52) U.S. Cl.
CPC ..... *B41J 2/1433* (2013.01); *B41J 2/145* (2013.01); *B41J 2/16505* (2013.01)

(58) Field of Classification Search
CPC ..... B41J 2/1433; B41J 2/145; B41J 2/16505
See application file for complete search history.

(56) References Cited

U.S. PATENT DOCUMENTS

| | | | | |
|---|---|---|---|---|
| 8,287,089 | B2 | 10/2012 | Kimura et al. | |
| 9,873,255 | B2 | 1/2018 | Sasaki | |
| 2007/0252865 | A1* | 11/2007 | Sakurai | B41J 2/16508 347/29 |
| 2017/0210129 | A1* | 7/2017 | Tamai | B41J 2/14274 |
| 2017/0282553 | A1* | 10/2017 | Hayashi | B41J 2/145 |

FOREIGN PATENT DOCUMENTS

JP 2009-202338 A 9/2009

* cited by examiner

*Primary Examiner* — Jason S Uhlenhake
(74) *Attorney, Agent, or Firm* — Venable LLP

(57) ABSTRACT

A liquid ejection head includes a liquid ejection face on which multiple ejection port arrays, each of which is formed with multiple ejection ports that eject liquid, are arranged. In the liquid ejection head, a first protrusion and a second protrusion, which have different sizes, are arranged in peripheral areas of the ejection port arrays on the liquid ejection face.

18 Claims, 10 Drawing Sheets

LIQUID EJECTION HEAD AND LIQUID EJECTION APPARATUS

BACKGROUND OF THE INVENTION

Field of the Invention

The present invention relates to a liquid ejection head and a liquid ejection apparatus.

Description of the Related Art

A liquid ejection head that ejects liquid from an ejection port of a nozzle, which is disposed on a liquid ejection face, to a print medium such as a print sheet conveyed in a predetermined direction is known. In a case where liquid adheres to the peripheral area of an ejection port of a nozzle, there is a possibility that the liquid to be ejected next from the nozzle is pulled in the radial direction of the ejection port due to the surface tension of the liquid that adheres to the periphery of the ejection port, so that the ejection direction (the fly direction of the liquid) deviates from the normal direction (the axial direction of the nozzle). Therefore, a liquid repellent film is formed on the liquid ejection face of a general liquid ejection head, so as to prevent liquid from adhering to the periphery of ejection ports.

By the way, a print sheet is usually conveyed at a position separated from the liquid ejection face by a predetermined distance (for example, 1 to 2 mm) in the ejection direction in which liquid is ejected. Therefore, in the normal sheet-conveyance state, print sheets do not come into contact with the liquid ejection face. However, for example, in a case of paper-jamming during printing, which causes floating of a print sheet, there is a possibility that the print sheet comes into contact with the liquid ejection face so that a liquid repellent film or an edge part of an ejection port is scratched. Alternatively, there is also a possibility that the liquid repellent film or the edge part of the ejection port is damaged because of a foreign substance from the outside making contact with the liquid ejection face. In Japanese Patent Laid-Open No. 2009-202338, there is disclosed a liquid ejection head including a liquid ejection face on which protrusions are arranged so as to physically protect the liquid repellent film formed in the peripheral area of ejection ports.

In an attempt of downsizing the nozzles or increasing the density of the nozzles provided with an energy-generating element, the area for forming protrusions, which are for protecting the liquid ejection face, is narrowed, so that it becomes difficult to maintain a desired protection performance.

SUMMARY OF THE INVENTION

The liquid ejection head according to an embodiment of the present invention is a liquid ejection head including a liquid ejection face on which a plurality of ejection port arrays are arranged, each of the plurality of ejection port arrays being formed with a plurality of ejection ports configured to eject liquid, wherein protrusions with different sizes are arranged in peripheral areas of the ejection port arrays on the liquid ejection face.

Further features of the present invention will become apparent from the following description of exemplary embodiments with reference to the attached drawings.

DESCRIPTION OF THE EMBODIMENTS

Hereinafter, embodiments will be explained with reference to the drawings. The same sign is assigned for explanations of the same element used in different configurations. In addition, the relative position, shape, and the like of the constituent elements described in the embodiments are merely examples.

First Embodiment

Figure 1:
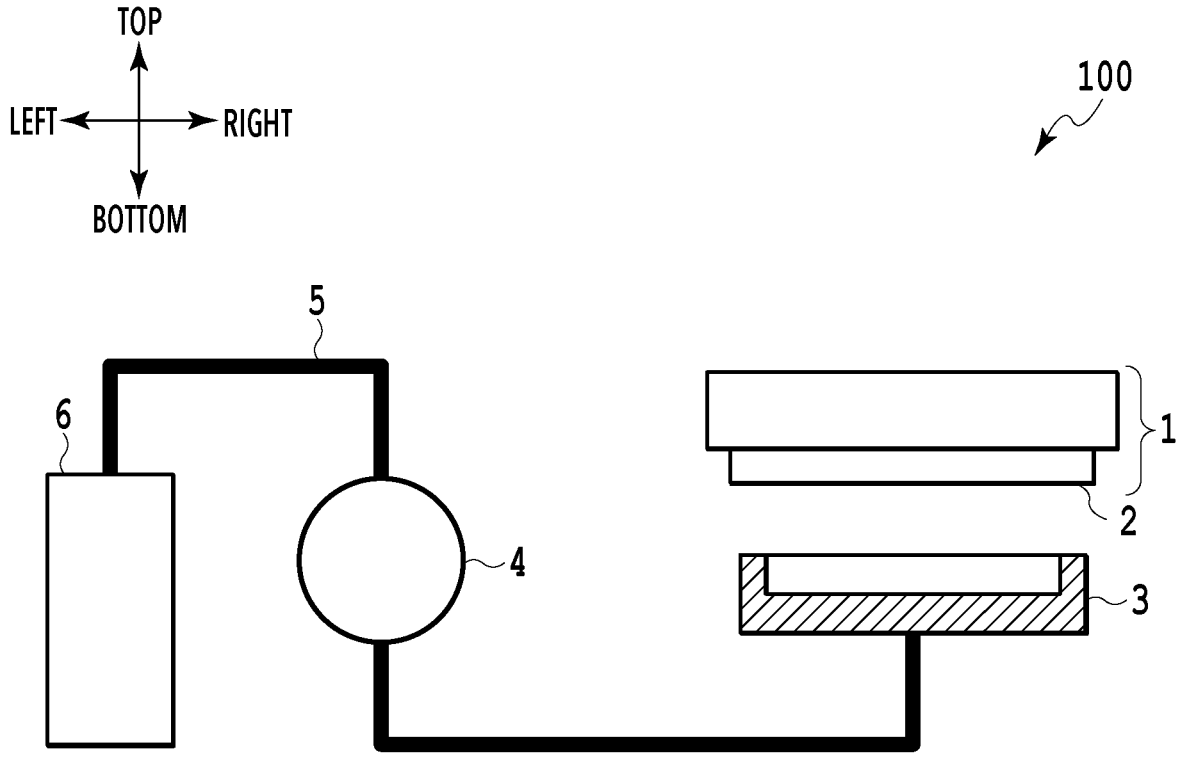
FIG. 1 is a schematic view of a liquid ejection apparatus.

FIG. 1 is a schematic view of the liquid ejection apparatus 100 to which the liquid ejection head 1 of the present embodiment is applied. In FIG. 1, a configuration of a part of the liquid ejection apparatus 100 is illustrated. The liquid ejection apparatus 100 includes the liquid ejection head 1 that ejects ink onto a print medium. The liquid ejection head 1 is mounted on a carriage (not illustrated in FIG. 1) that is movable in the scanning direction (for example, the left-right direction). On a surface of the liquid ejection face 2 of the liquid ejection head, there are formed a liquid repellent film, a protective protrusion, and an ejection port (not illustrated in FIG. 1) which are arranged so as to face downward in FIG. 1. A small-capacity tank (not illustrated in FIG. 1) is mounted on the carriage, so that ink is supplied from an ink tank to the small-capacity tank on the carriage by a tube. The liquid ejection apparatus 100 includes a cap 3. It is possible to attach the cap 3 to the liquid ejection face 2, so as to prevent ink, which is supplied to the liquid ejection head 1, from thickening on the liquid ejection face 2 due to evaporation. Further, there is included such a configuration in which the cap 3 is attached and the thickened ink is suctioned by the pump 4 so that the thickened ink is discharged as waste liquid through the waste liquid tube 5 into the waste liquid reservoir 6.

Figure 2A:
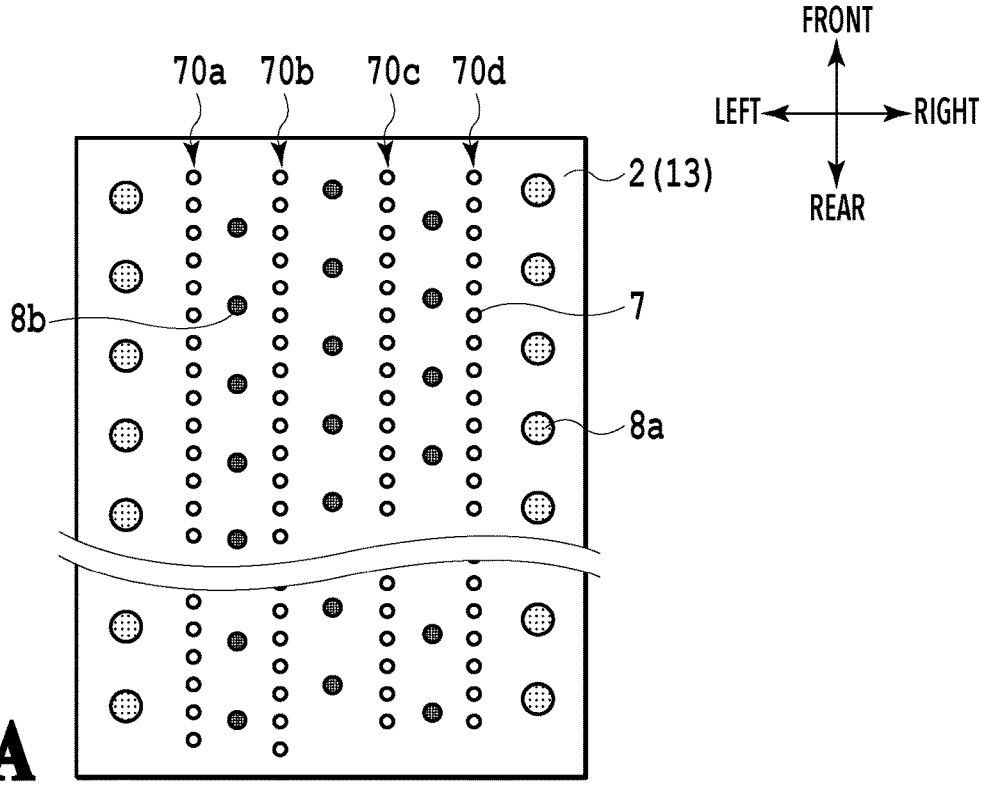
FIGS. 2A through 2C are diagrams for explaining a liquid ejection face and a protective protrusion.
Figure 2B:
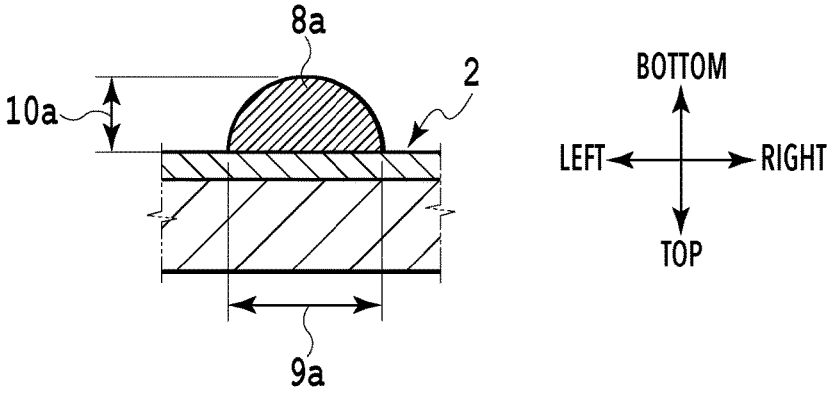
Figure 2C:
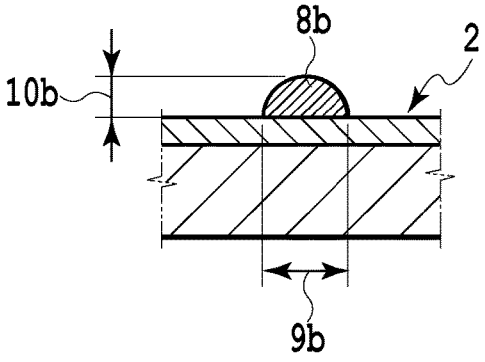

FIGS. 2A through 2C are diagrams for explaining a liquid ejection face and protective protrusions. FIG. 2A is a schematic plan view of the liquid ejection face 2 of the liquid ejection head 1, which is illustrated in FIG. 1, as viewed from a side to which the liquid is ejected. FIG. 2B is a schematic cross-sectional view of the vicinity of a protrusion part for explaining a protective protrusion 8. The liquid ejection face 2 and the protective protrusion 8 will be explained with reference to FIGS. 2A and 2B. In the present specification, in a case where a letter is attached to the end of a reference sign of a particular element it is assumed that the element is individually referred to, and the end of the reference sign may be omitted for describing a common feature.

As illustrated in FIG. 2A, the liquid repellent film 13 is formed on the liquid ejection face 2. Although it is assumed that the liquid repellent film 13 is formed in a part excluding the ejection ports 7 and the protective protrusions 8 on the liquid ejection face 2 in the present example, the present embodiment is not limited as such. It is also possible that the liquid repellent film 13 is formed on the protective protrusions 8 as well and that the liquid repellent film 13 is formed only in the peripheral areas of the ejection ports 7. The liquid repellent film 13 is formed for preventing liquid from adhering to the peripheries of the ejection ports 7.

On the liquid ejection face 2, there are formed the ejection ports 7 from which liquid is ejected. In the ejection ports 7, there are provided energy-generating elements (not illustrated in FIG. 2A through 2C) that generate energy for ejecting liquid, respectively. Multiple ejection ports 7 are arranged side by side in the front-rear direction (also referred to as the ejection port array direction) in FIG. 2A. Further, multiple ejection port arrays 70, each of which is arranged in the above-described manner, are arranged in a direction (left-right direction) intersecting the ejection port array direction. In the example of FIG. 2A, the ejection port arrays (also referred to as nozzle arrays) to which black, yellow, magenta, and cyan inks are supplied are arranged as ejection port arrays 70*a*, 70*b*, 70*c*, and 70*d*, respectively.

In an area other than the ejection port arrays 70 on the liquid ejection face 2, there are provided protective protrusions 8 for protecting the liquid repellent film 13. The protective protrusions 8 are arranged in the peripheral areas of the ejection port arrays 70 in which the ejection ports 7 are arranged. For example, multiple protective protrusions 8 are arranged side by side so as to have a predetermined distance from each other in the same direction as the ejection port array direction in which the ejection ports 7 are arranged. Specifically, from the viewpoint of the ejection port array 70*a*, the protective protrusions 8 are arranged side by side in an outer peripheral part, which is between the ejection port array 70*a* and the outer peripheral end of the liquid ejection face 2. Further, the protective protrusions 8 are arranged side by side in a part between ejection port arrays, which is between the ejection port array 70*a* and the ejection port array 70*b* adjacent thereto. That is, the protective protrusions 8 are arranged in the outer peripheral parts or the parts between ejection port arrays, which are peripheral areas of the ejection port arrays 70, on the liquid ejection face 2. Further, the protective protrusions 8 form protrusion arrays in the same direction as the array direction of the ejection port arrays.

FIG. 2B is an enlarged schematic cross-sectional view of a protective protrusion 8 formed on the liquid ejection face 2, and, for example, the size of the protective protrusion 8 is defined by a protrusion width 9 and a protrusion height 10. The tip shape of the protrusion part of the protective protrusion 8 is not particularly limited, but it is desirable to have an arcuate shape from the viewpoint of avoiding stress against physical impact. Further, regarding the protective protrusion 8, although it is illustrated in FIG. 2B that the part protruding from the liquid ejection face 2 is additionally provided, it is only needed that the protective protrusion 8 protrudes from the liquid ejection face 2, and the protective protrusion 8 is not limited to the one that is additionally provided. For example, it is also possible that the surface profile of the liquid protective protrusion configuration is formed up to the inside of the liquid ejection face 2.

Regarding the ejection port arrays 70, it is possible that multiple ejection port arrays of a single color are provided, and it is also possible that ejection port arrays 70 of multiple colors are provided so as to respectively form multiple arrays. Furthermore, the protective protrusions 8 are not limited to the example of being evenly arranged on the liquid ejection face 2, and the protective protrusions 8 can be freely arranged on the liquid ejection face 2.

The liquid ejection head 1 of the present embodiment includes protective protrusions 8 with different sizes arranged on the liquid ejection face 2. Hereinafter, the details of the liquid ejection head 1 of the present embodiment will be explained with reference to FIGS. 2A, 2B, and 2C.

In FIG. 2A, there are two different sizes of protective protrusions, that is, protective protrusions 8*a* in the outer peripheral parts of the liquid ejection face 2 and protective protrusions 8*b* in the part between ejection port arrays. FIGS. 2B and 2C are enlarged cross-sectional schematic views corresponding to the protective protrusions 8*a* and 8*b* illustrated in FIG. 2A, respectively. For the sake of explanation, FIGS. 2B and 2C are upside-down views of FIG. 1. The size of a protective protrusion 8*a* is defined by a protrusion width 9*a* and a protrusion height 10*a*. The size of a protective protrusion 8*b* is defined by a protrusion width 9*b* and a protrusion height 10*b*. Both of the protective protrusion 8*a* and the protective protrusion 8*b* have sizes with a protrusion width 9 that is longer than a protrusion height 10. Furthermore, the protective protrusion 8*a* (also referred to as the first protrusion) is larger in size than the protective protrusion 8*b* (also referred to as the second protrusion).

As described above, in an attempt of downsizing the nozzles or increasing the density of the nozzles provided with an energy-generating element, the area for forming protective protrusions 8*b*, which are for protecting the liquid ejection face 2 between ejection port arrays, is narrowed. As a result, there is a case in which the protrusion height 10*b* of the protective protrusions 8*b* becomes shorter than a desired height. On the other hand, in the outer peripheral parts of the liquid ejection face 2, the area for forming protective protrusions 8*a* is not narrowed even in a case where the nozzles are downsized or the density of the nozzles is increased. That is, the area in which protective protrusions 8*a* can be arranged in the outer peripheral parts of the liquid ejection face 2 is larger than the area in which protective protrusions 8*b* can be arranged between ejection port arrays. Therefore, in the example of FIGS. 2A through 2C, the protrusion width 9*a* and the protrusion height 10*a* of the protective protrusions 8*a* can be formed so as to be higher than the protrusion width 9*b* and the protrusion height 10*b* of the protective protrusions 8*b*.

In this way, by making the size of the protective protrusions 8*a* arranged in the outer peripheral parts larger than the size of the protective protrusions 8*b* arranged in the parts between ejection port arrays, it is possible to improve the surface protection performance of the liquid repellent film formed on the liquid ejection face 2. That is, even in a case where the size of the protective protrusions 8*b* arranged in the parts between ejection port arrays are to be small in accordance with downsizing or an increase in the density of the nozzles, it is possible to improve the surface protection performance of the liquid ejection face 2 by providing the protective protrusion 8*a* arranged in the outer peripheral parts.

Although the example in which protective protrusions of two different sizes are arranged on the liquid ejection face 2 is explained with reference to FIGS. 2A through 2C, the present embodiment is not limited as such. It is also possible that protective protrusions of three or more different sizes are arranged on the liquid ejection face 2. Furthermore, regarding a protective protrusion array of the same type (same size), the size (protrusion width and protrusion height) of each protective protrusion may not be completely the same, that is, the size may differ due to manufacturing tolerances.

Figure 3:
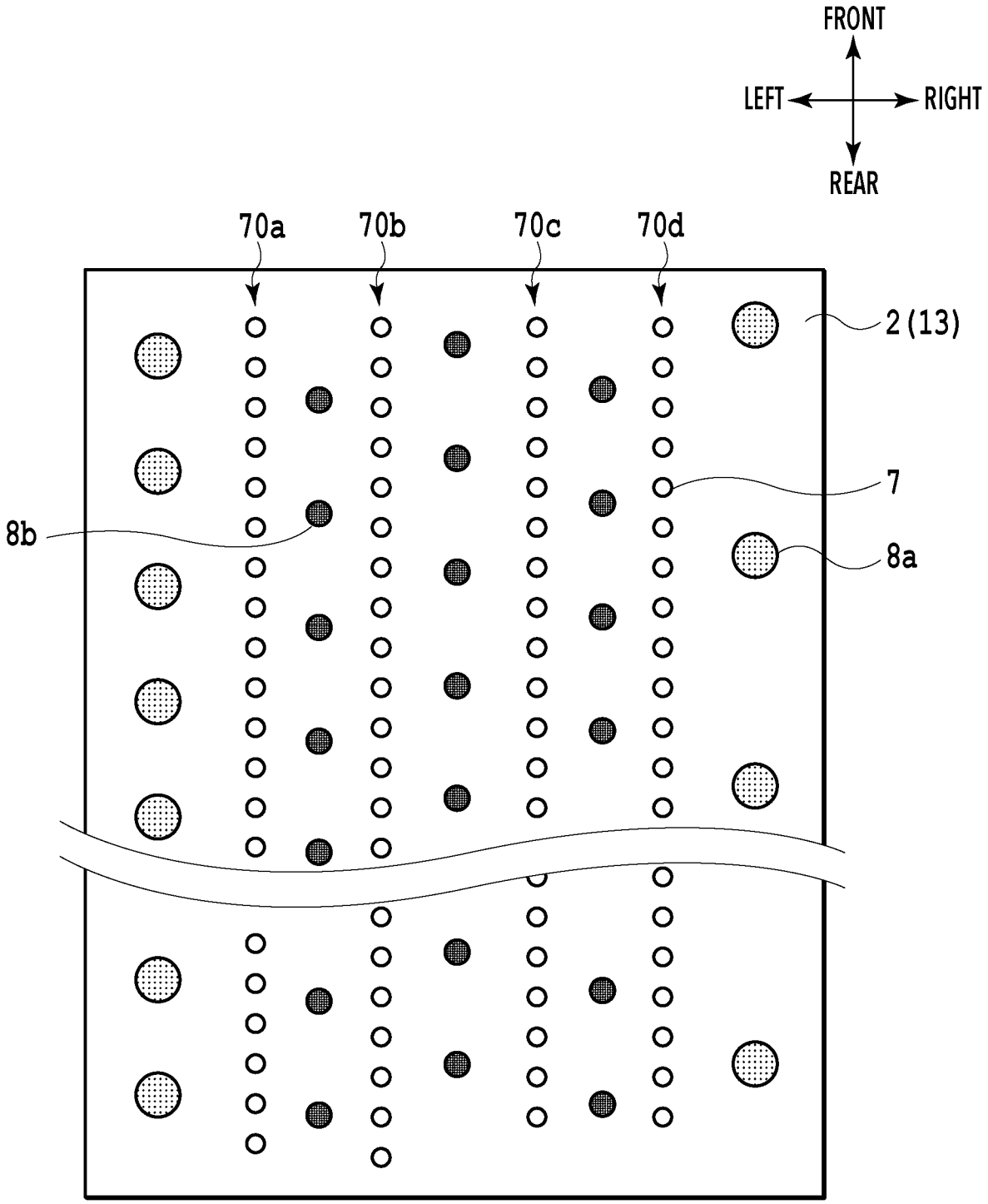
FIG. 3 is a diagram illustrating an arrangement example of the liquid ejection face.

FIG. 3 is a diagram illustrating another arrangement example of the liquid ejection face 2. As with FIG. 2A, FIG. 3 is also a diagram illustrating an example in which the size of the protective protrusions 8*a* arranged in the outer peripheral parts is formed so as to be larger than the size of the protective protrusions 8*b* arranged in the parts between ejection port arrays. In FIG. 3, unlike FIG. 2A, the protective protrusions 8*a* in the outer peripheral parts are asymmetrically arranged on the liquid ejection face 2. Even in such a form, it is possible to improve the surface protection performance of the liquid ejection face 2 by providing the protective protrusions 8*a* arranged in the outer peripheral parts.

Figure 4:
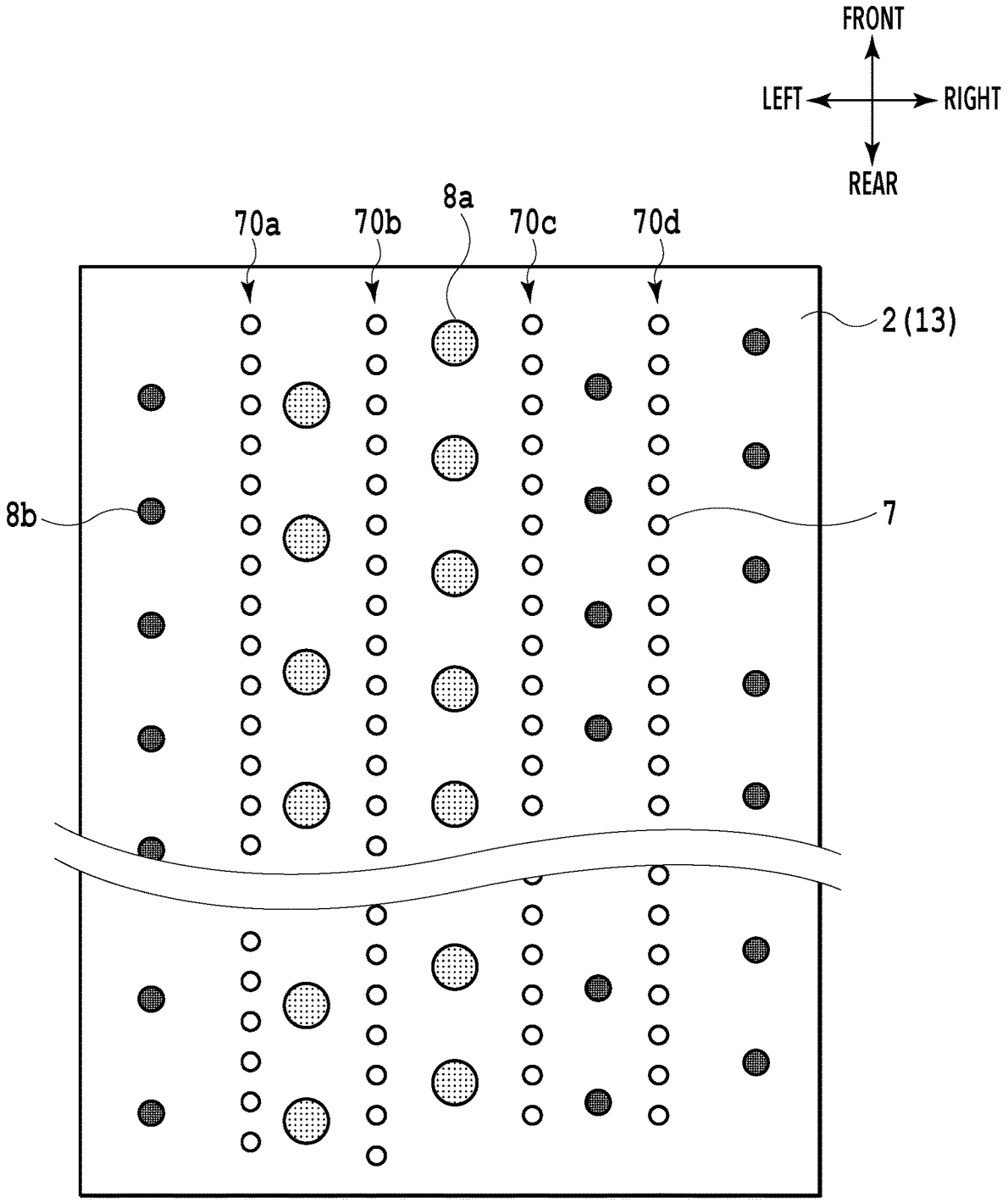
FIG. 4 is a diagram illustrating an arrangement example of the liquid ejection face.

FIG. 4 is a diagram illustrating another arrangement example of the liquid ejection face 2. In FIG. 4, the example in which the protective protrusions 8*a* in a part of the space between ejection port arrays are formed so as to be larger than the protective protrusions 8*b* in another part is illustrated. As illustrated in FIG. 4, it is also possible to increase the protrusion height only in the periphery of the ejection port array that is desired to be particularly protected. Furthermore, even in the case of FIG. 4, the height of the protective protrusions 8*b* in the outer peripheral parts can be designed to have the same size as the protective protrusions 8*a* in the periphery of the ejection port array that is desired to be protected.

Figure 5:
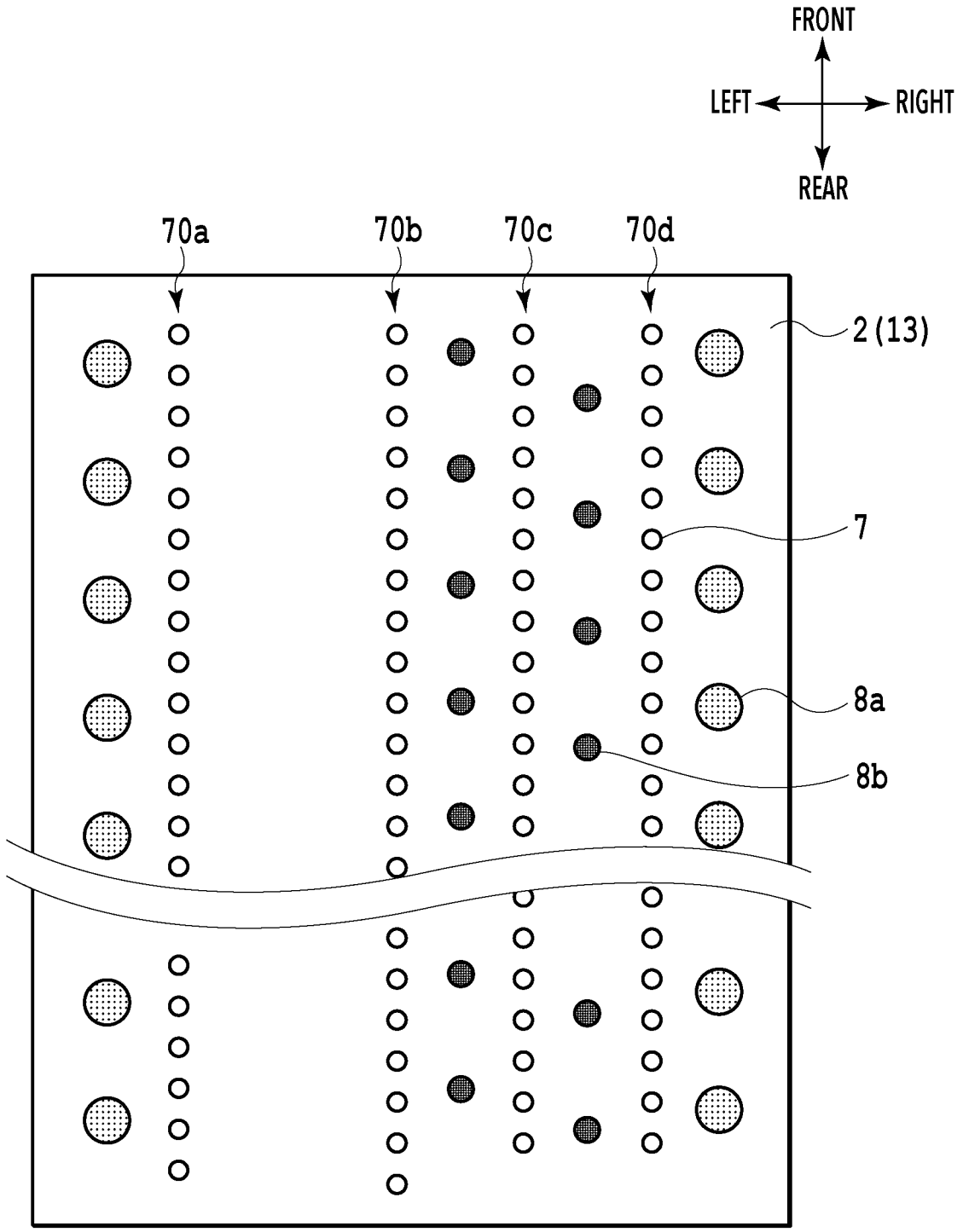
FIG. 5 is a diagram illustrating an arrangement example of the liquid ejection face.

FIG. 5 is a diagram illustrating another arrangement example of the liquid ejection face 2. In FIG. 5, the liquid ejection head 1 in which a part of the space between ejection port arrays 70 is wider than another part of the space between ejection port arrays 70 is illustrated. In FIG. 5, the space between the ejection port array 70*a* and the ejection port array 70*b* is wider than the spaces between other ejection port arrays 70. As illustrated in FIG. 5, such a configuration in which protective protrusions 8 are not arranged in this space between the ejection port array 70*a* and the ejection port array 70*b* is also possible.

Second Embodiment

In the first embodiment, an explanation is given of the liquid ejection head 1 in which the protrusion height 10*a* of the protective protrusions 8*a* in a partial area of the liquid ejection face 2 is configured to be larger than the protrusion height 10*b* of the protective protrusions 8*b* in another area. In the present embodiment, an explanation will be given of the liquid ejection head 1 in which the protrusion height 10*a* of the protective protrusions 8*a* in a partial area of the liquid ejection face 2 is formed to be about the same size as the protrusion height 10*b* of the protective protrusions 8*b* in another area.

Figure 6:
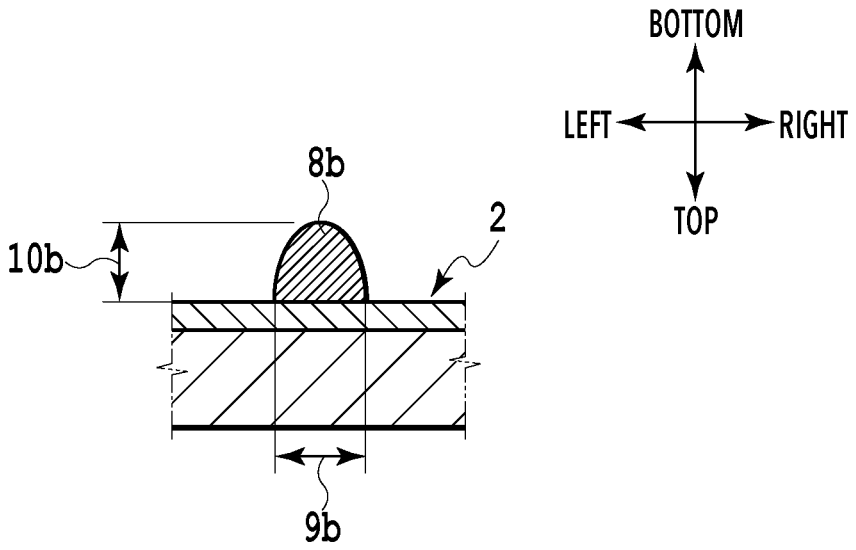
FIG. 6 is a diagram illustrating an arrangement example of the liquid ejection face.

FIG. 6 is a diagram illustrating a protective protrusion 8*b* in a part between ejection port arrays in the present embodiment. It is assumed that the arrangement of each protective protrusion 8 on the liquid ejection face 2 of the present embodiment is the same as that illustrated in FIG. 2A.

In the present embodiment, the protective protrusions 8*b* are formed so that the ratio of the protrusion height 10*b* to the protrusion width 9*b* of the protective protrusions 8*b* in the parts between ejection port arrays is larger than the ratio of the protrusion height 10*a* to the protrusion width 9*a* in the protective protrusions 8*a* in the outer peripheral parts. For example, as illustrated in FIG. 6, the protrusion height 10*b* of the protective protrusions 8*b* in the parts between ejection port arrays is designed to be the same as the protrusion height 10*a* of the protective protrusions 8*a* in the outer peripheral parts. Even in this case, the size of the protective protrusions 8*b* in the parts between ejection port arrays is configured to be different from the size of the protective protrusions 8*a* in the outer peripheral parts. That is, even though the protrusion heights 10 of the protective protrusions 8 are the same, the sizes of the protective protrusions 8*a* and the protective protrusions 8*b* are different since the protrusion widths 9 of the protective protrusions 8 are different. In this way, the ratios of the protrusion height 10 to the protrusion width 9 can be different between the protective protrusions 8*a* in the outer peripheral parts and the protective protrusions 8*b* in the parts between ejection port arrays. More specifically, the protective protrusions can be formed so that the above-mentioned ratio of the protective protrusions 8*b* in the parts between ejection port arrays is larger than the above-mentioned ratio of the protective protrusions 8*a* in the outer peripheral parts.

In this way, in the present embodiment, the protrusion height 10*b* of the protective protrusions 8*b* in the parts between ejection port arrays is designed to be the same as the protrusion height 10*a* of the protective protrusions 8*a* in the outer peripheral parts. That is, the ratios of the protrusion height 10 to the protrusion width 9 are designed to be different. Accordingly, it is possible to improve the surface protection performance, compared to the case in which the protective protrusions 8 are formed with the same ratio. That is, in the case of the example in FIG. 6, it is possible to further improve the surface protection performance since the protrusion height 10*b* of the protective protrusions 8*b* in the parts between ejection port arrays is higher than that of the example in FIGS. 2A through 2C.

Although the explanation is given of the example of FIG. 6 in which the protective protrusions 8 are formed so that the protrusion heights 10 of the protective protrusions 8*a* in the outer peripheral parts and the protective protrusions 8*b* in the parts between ejection port arrays are designed to be the same height, the present embodiment is not limited as such. It is only needed that the ratio of the protrusion height 10 to the protrusion width 9 of the protective protrusions 8 arranged in the area with a narrowed placement region is larger than that of the protective protrusions 8 arranged in the other areas. In the various arrangement examples explained in the first embodiment, it is also possible that protective protrusions 8 with different ratios, which are explained in the present embodiment, are arranged.

Third Embodiment

In the first embodiment and the second embodiment, the explanations are mainly given of the liquid ejection heads 1 in which ejection port arrays 70 are arranged so that each space between the ejection port arrays 70 is approximately even on the liquid ejection face 2. In the present embodiment, an explanation is given of the liquid ejection head 1 in which a part of the space between ejection port arrays 70 is wider than another part of the space between ejection port arrays 70 on the liquid ejection face 2.

Figure 7A:
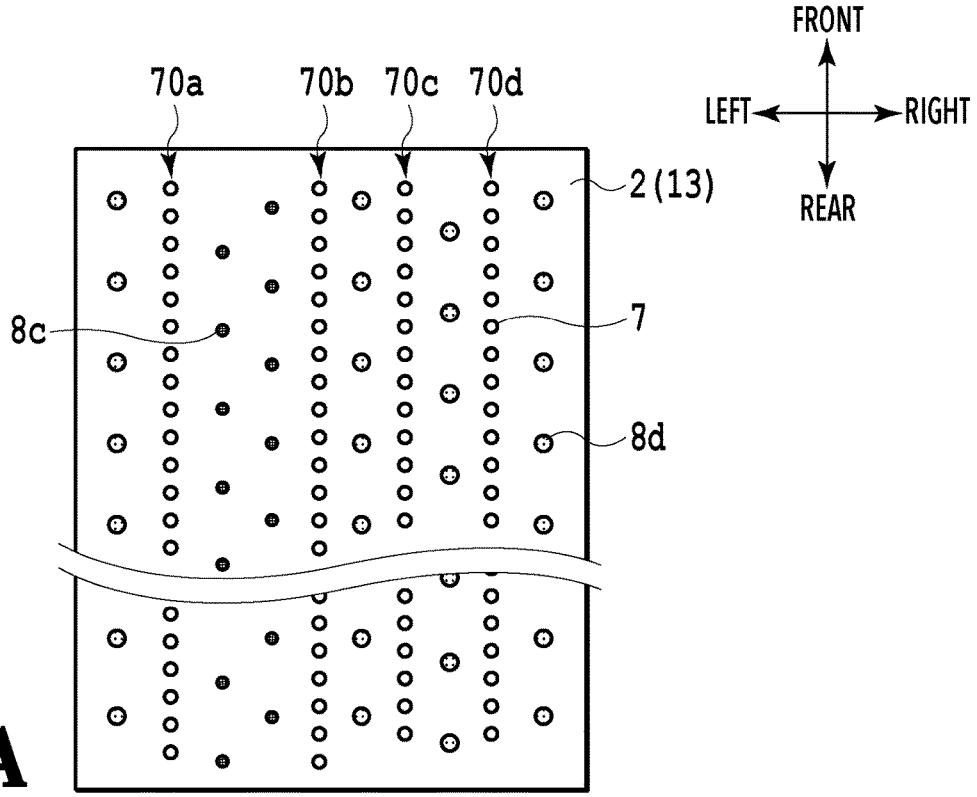
FIGS. 7A through 7C are diagrams illustrating an arrangement example of the liquid ejection face.
Figure 7B:
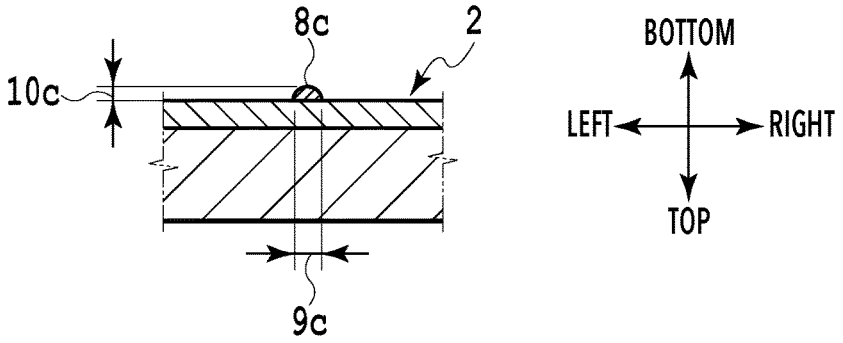
Figure 7C:
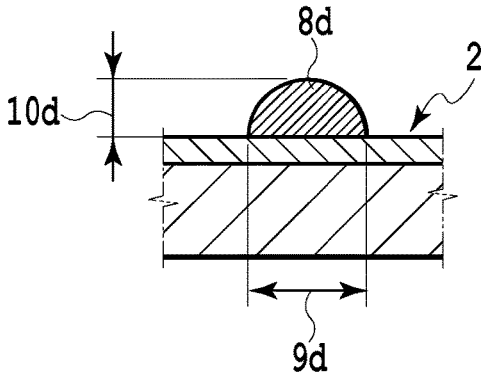

FIGS. 7A through 7C are diagrams illustrating an arrangement example of the liquid ejection face 2 of the present embodiment. FIGS. 7A through 7C are diagrams for explaining the liquid ejection head 1 in which a part of the space between ejection port arrays 70 is wider than another part of the space between ejection port arrays 70 on the liquid ejection face 2. FIG. 7A is a schematic plan view of the liquid ejection face 2 of the liquid ejection head 1. FIG. 7B is a schematic cross-sectional view of a protrusion part for explaining a protective protrusion 8.

Figure 8:
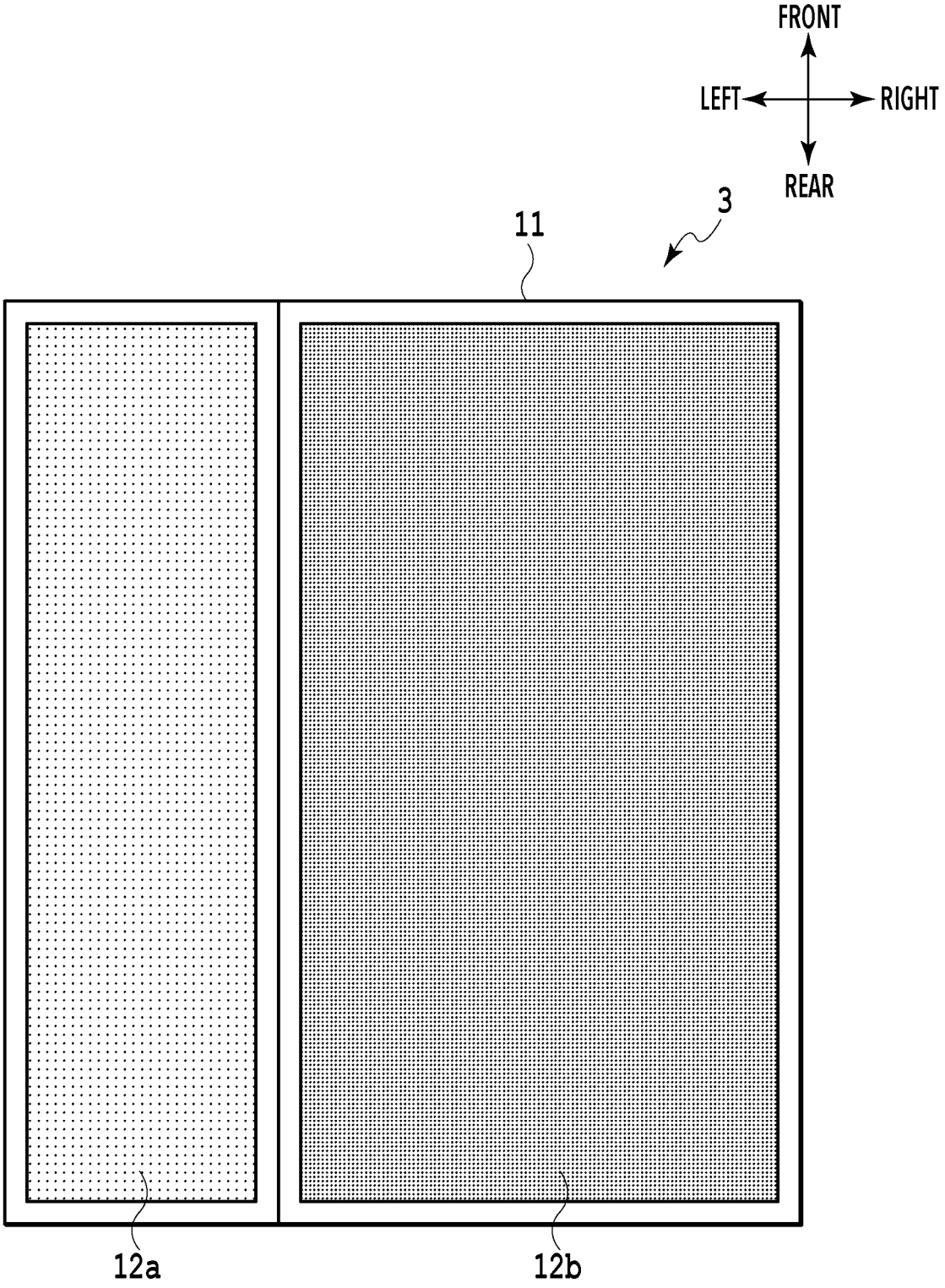
FIG. 8 is a schematic plan view of a cap.

FIG. 8 is a schematic plan view of the cap 3 as viewed from a side toward which the cap 3 comes into contact with the liquid ejection face 2. Hereinafter, with reference to FIGS. 7A and 7B and FIG. 8, an explanation is given of the liquid ejection head 1 in which the protective protrusions 8*c*, which are minute protrusions, are formed in the part with which the cap 3 comes into contact.

FIG. 7A is a schematic plan view of the liquid ejection face 2 in a case where, for example, the space between the ejection port arrays 70*a* and 70*b* is wider than the spaces between the other pairs of ejection port arrays. In the multicolored liquid ejection head 1, as illustrated in FIG. 7A, there is a case in which the ejection port array 70*a* is arranged separately from the ejection port arrays 70*b* through 70*d* on the liquid ejection face 2. That is, compared to the interval between the ejection port array 70*a* (first ejection port array) and the ejection port array 70*b* (second ejection port array) which is adjacent thereto, the interval between the ejection port array 70*b* and the ejection port array 70*c* (third ejection port array) which is adjacent thereto is shorter. Further, according to such an arrangement of ejection port arrays, there is a case of avoiding color mixture by use of the cap 3 having such a configuration as illustrated in FIG. 8.

For example, the area 12*a* of the cap 3 corresponds to the black ejection port array 70*a*. The area 12*b* of the cap 3 corresponds to the yellow, magenta, and cyan ejection port arrays 70*b*, 70*c*, and 70*d*. The area 12*a* is open so as to cover the ejection port array 70*a*, and the area 12*b* is open so as to cover the ejection port arrays 70*b*, 70*c*, 70*d*. Further, in the state where the liquid ejection face 2 is covered with the cap 3, the edge part of the capping member 11 between the area 12*a* and the area 12*b* is in contact with the protective protrusions 8*c*.

In the example illustrated in FIG. 7A, the protective protrusions 8*c*, which are arranged between the ejection port array 70*a* and the ejection port array 70*b* on the liquid ejection face 2, and the protective protrusions 8*d*, which are arranged in the other part of the liquid ejection face 2, have different sizes. FIGS. 7B and 7C are enlarged cross-sectional schematic views corresponding to the protective protrusions 8*c* and protective protrusions 8*d* illustrated in FIG. 7A, respectively. The size of a protective protrusion 8*c* is defined by a protrusion width 9*c* and a protrusion height 10*c*. The size of a protective protrusion 8*d* is defined by a protrusion width 9*d* and a protrusion height 10*d*.

Figure 9:
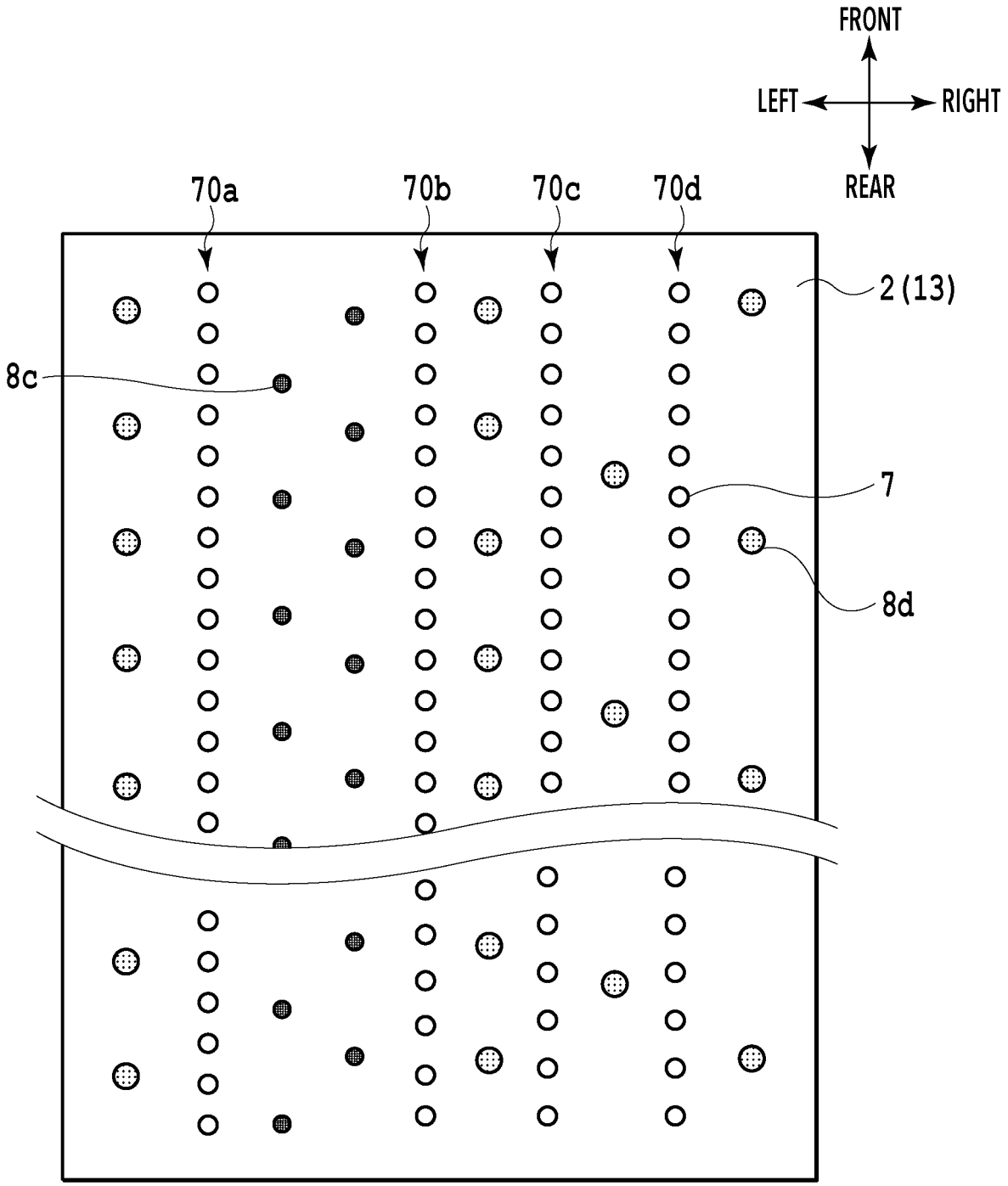
FIG. 9 is a diagram illustrating an arrangement example of the liquid ejection face.

The protective protrusion 8*c* is a protrusion arranged at a position facing the capping member 11 (that is, a position that comes into contact with the capping member 11). Therefore, the protective protrusion 8*c* is required to have a protrusion width 9*c* and a protrusion height 10*c* that do not hinder the capping with the capping member 11 illustrated in FIG. 8. For example, in a case where the Young's modulus of the capping member 11, which is an elastic member, is about 0.01 GPa, the tolerance of the protrusion height is about 0.8 mm and the tolerance of the protrusion interval is about 1 mm. In a case where the Young's modulus of the capping member 11 is about 0.1 GPa, the tolerance of the protrusion height is about 0.08 mm and the tolerance of the protrusion interval is about 1 mm. There is not limitations on the protective protrusions 8*d* arranged in the parts (that is, the positions that do not come into contact with the capping member 11) other than the space between the ejection port array 70*a* and the ejection port array 70*b* as long as the protective protrusions 8*d* are larger in size than the protective protrusions 8*c*. Further, as explained in the second embodiment, it is also possible that a protective protrusion with a different protrusion width 9 or protrusion height 10 and a protective protrusion with a different ratio of the protrusion height 10 to the protrusion width 9 are arranged among the protective protrusions 8*d*. FIG. 9 is a diagram illustrating another arrangement example of the liquid ejection face 2. In FIG. 9, an example in which the protective protrusions 8*d*, which are arranged in the parts other than the area between the ejection port array 70*a* and the ejection port array 70*b* on the liquid ejection face 2, are not symmetrically arranged on the liquid ejection face 2 is illustrated. Alternatively, there may also be such a configuration in which the protective protrusions 8*c*, which are arranged in the space between the ejection port array 70*a* and the ejection port array 70*b* on the liquid ejection face 2, are not symmetrically arranged.

Figure 10:
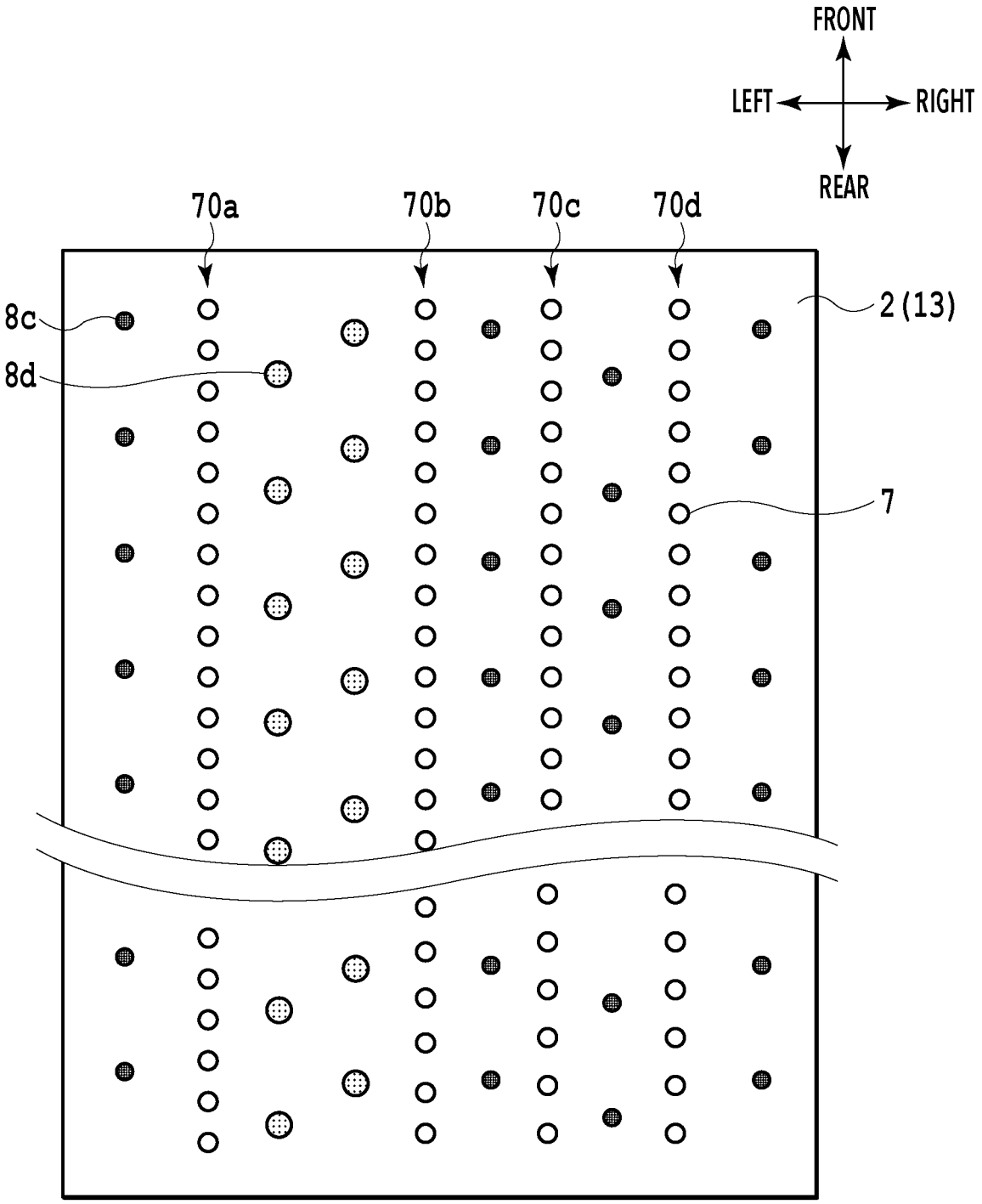
FIG. 10 is a diagram illustrating an arrangement example of the liquid ejection face.

FIG. 10 is a diagram illustrating another arrangement example of the liquid ejection face 2. In FIG. 10, the protective protrusions 8*d*, which are arranged between the ejection port array 70*a* and the ejection port array 70*b* on the liquid ejection face 2, and the protective protrusions 8*c*, which are arranged in the other part of the liquid ejection face 2, are included. In FIG. 10, the example in which the size of the protective protrusions 8*d* arranged between the ejection port array 70*a* and the ejection port array 70*b* is larger than the size of the protective protrusions 8*c* arranged in the other parts is illustrated. The size of the protective protrusions 8*d* arranged between the ejection port array 70*a* and the ejection port array 70*b* of the liquid ejection face 2 can be designed to be larger than the protective protrusions 8*c* arranged in the other parts in a range that does not cause a problem for the capping with the cap 3.

As explained above, in the present embodiment, it is possible to improve the surface protection performance of the liquid ejection face 2 even in a case where the capping with the cap 3 is performed so as to avoid color mixture.

OTHER EMBODIMENTS

Although the examples in which four ejection port arrays 70 are arranged are respectively explained in the above-explained embodiments, the present embodiments are not limited as such. The present embodiments can be applied as long as multiple ejection port arrays 70 are present on the liquid ejection face 2 so that there are multiple areas between ejection port arrays.

Further, regarding the liquid ejection apparatus 100, although the examples of the liquid ejection head 1 which performs scanning by use of the carriage are respectively explained in the above-explained embodiments, it is also possible that the liquid ejection apparatus 100 is applied to what is termed as a line-head in which ejection ports 7 are arranged so as to correspond to the width of a print medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-000878, filed Jan. 7, 2020, which is hereby incorporated by reference herein in its entirety.

What is claimed is:

1. A liquid ejection head comprising a liquid ejection face on which a plurality of ejection port arrays are arranged, each of the plurality of ejection port arrays being formed with a plurality of ejection ports configured to eject liquid, wherein protrusions with different sizes are arranged in peripheral areas of the ejection port arrays on the liquid ejection face, wherein the plurality of ejection port arrays include a first ejection port array, a second ejection port array that is adjacent to the first ejection port array, and a third ejection port array that is adjacent to the second ejection port array, the second ejection port array and the third ejection port array having an interval therebetween that is shorter than an interval between the first ejection port array and the second ejection port array, and wherein, on the liquid ejection face, the protrusions with different sizes are arranged between the first ejection port array and the second ejection port array and between the second ejection port array and the third ejection port array.

2. The liquid ejection head according to claim 1, wherein the protrusions have different widths and heights.

3. The liquid ejection head according to claim 1, wherein the protrusions have different ratios between a height and a width.

4. The liquid ejection head according to claim 1, wherein the protrusions include first protrusions and a second protrusion that is smaller in size than the first protrusion, and wherein at least one of the first protrusions is arranged in an outer peripheral part of the liquid ejection face.

5. The liquid ejection head according to claim 4, wherein a plurality of protrusion arrays are arranged along an array direction of the ejection port arrays, each of the plurality of protrusion arrays being configured with a plurality of the first protrusions, and wherein the protrusion arrays are symmetrically arranged.

6. The liquid ejection head according to claim 4, wherein a plurality of protrusion arrays are arranged along an array direction of the ejection port arrays, each of the plurality of protrusion arrays being configured with a plurality of the first protrusions, and wherein the protrusion arrays are asymmetrically arranged.

7. The liquid ejection head according to claim 4, wherein a plurality of protrusion arrays are arranged along an array direction of the ejection port arrays, each of the plurality of protrusion arrays being configured with a plurality of the second protrusions, and wherein the protrusion arrays are symmetrically arranged.

8. The liquid ejection head according to claim 4, wherein a plurality of protrusion arrays are arranged along an array direction of the ejection port arrays, each of the plurality of protrusion arrays being configured with a plurality of the second protrusions, and wherein the protrusion arrays are asymmetrically arranged.

9. The liquid ejection head according to claim 4, wherein a protrusion array configured with a plurality of the first protrusions is arranged along an array direction of the ejection port arrays, and a protrusion array configured with a plurality of the second protrusions is arranged along the array direction.

10. The liquid ejection head according to claim 1, wherein the protrusions include a first protrusion and a second protrusion that is smaller in size than the first protrusion, and wherein the second protrusion is arranged in a part between the first ejection port array and the second ejection port array.

11. The liquid ejection head according to claim 10, wherein a ratio of a height to a width of the second protrusion is greater than a ratio of a height to a width of the first protrusion.

12. The liquid ejection head according to claim 1, wherein the protrusions include a first protrusion and a second protrusion that is smaller in size than the first protrusion, and wherein the first protrusion is arranged in a part between the second ejection port array and the third ejection port array.

13. The liquid ejection head according to claim 1, wherein the protrusions include a first protrusion and a second protrusion that is smaller in size than the first protrusion, and wherein the first protrusion is arranged between the second ejection port array and the third ejection port array, and the second protrusion is arranged between the first ejection port array and the second ejection port array.

14. The liquid ejection head according to claim 1, wherein a liquid repellent film is formed on the liquid ejection face.

15. A liquid ejection head comprising a liquid ejection face on which a plurality of ejection port arrays are arranged, each of the plurality of ejection port arrays being formed with a plurality of ejection ports configured to eject liquid, wherein the liquid ejection face includes an area that divides the liquid ejection face where an elastic member makes contact with the liquid ejection face, wherein, on the liquid ejection face, protrusions with different sizes are arranged in the area and a part other than the area, wherein the plurality of ejection port arrays include a first ejection port array, a second ejection port array that is adjacent to the first ejection port array, and a third ejection port array that is adjacent to the second ejection port array, the second ejection port array and the third ejection port array having an interval therebetween that is shorter than an interval between the first ejection port array and the second ejection port array, and wherein, on the liquid ejection face, the protrusions with different sizes are arranged between the first ejection port array and the second ejection port array and between the second ejection port array and the third ejection port array.

16. The liquid ejection head according to claim 15, wherein the protrusions with different sizes have different widths and heights.

17. The liquid ejection head according to claim 15, wherein the protrusions with different sizes have different ratios between a height and a width.

18. The liquid ejection head according to claim 15, wherein the protrusions include a first protrusion and a second protrusion that is smaller in size than the first protrusion, and the second protrusion is arranged in the area.

* * * * *